US011383155B1

(12) United States Patent
Jiang et al.

(10) Patent No.: US 11,383,155 B1
(45) Date of Patent: Jul. 12, 2022

(54) EDUCATIONAL TOY

(71) Applicant: Quanzhou Kuanrui Information Technology Co. Ltd., Quanzhou (CN)

(72) Inventors: Aihong Jiang, Quanzhou (CN); Yichen Li, Quanzhou (CN); Yuxuan Xie, Quanzhou (CN); Xiaonuo Xu, Quanzhou (CN); Xiaoyan Xu, Xiamen (CN); Chuyi Xu, Quanzhou (CN)

( * ) Notice: Subject to any disclaimer, the term of this patent is extended or adjusted under 35 U.S.C. 154(b) by 0 days.

(21) Appl. No.: 17/567,112

(22) Filed: Jan. 1, 2022

(30) Foreign Application Priority Data

Nov. 22, 2021 (CN) ..... 202111388703.2

(51) Int. Cl.
*A63F 9/06* (2006.01)

(52) U.S. Cl.
CPC ..... *A63F 9/06* (2013.01)

(58) Field of Classification Search
CPC ..... A63F 9/06; A63F 9/0096; A63F 3/00145; A63F 2003/00264; A63F 2003/00268; A63F 2003/00274; A63F 2003/00277; A63F 2003/0041; A63F 7/0023
USPC ..... 434/258; 273/109, 127 A, 127 D, 129 V, 273/129 W, 280, 281, 330, 331, 335, 273/341.1, 351, 355, 356, 357, 359, 368, 273/393, 403, 405, 406, 407, 408; 446/4
See application file for complete search history.

(56) References Cited

U.S. PATENT DOCUMENTS 2,657,057 A * 10/1953 Chapin ..... A63F 9/02 273/357
3,339,921 A * 9/1967 Glass ..... A63F 9/0096 273/445
3,711,100 A * 1/1973 Crowder ..... A63F 7/305 273/127 R
3,841,629 A * 10/1974 Barlow ..... A63F 9/00 273/459
3,888,488 A * 6/1975 Sims ..... A63F 9/02 273/386
4,061,334 A * 12/1977 Kanno ..... A63F 9/02 273/109
4,186,927 A * 2/1980 Breslow ..... A63F 9/0079 273/357
4,227,690 A * 10/1980 Pitkanen ..... A63F 9/0096 273/143 A
4,229,003 A * 10/1980 Shimizu ..... A63F 9/34 273/448
4,266,767 A * 5/1981 Spring ..... A63H 13/06 273/447
4,309,034 A * 1/1982 Matsumoto ..... A63F 9/30 273/357
4,319,751 A * 3/1982 Kurushima ..... A63H 13/06 446/4
4,406,231 A * 9/1983 Grimaldi ..... A63H 18/14 105/29.2

(Continued)

*Primary Examiner* — Joseph B Baldori

(57) ABSTRACT

The disclosure provides an educational toy. The educational toy incudes a base, a rotatable frame, at least one clamping claw, and at least one impact device. The base is configured for placing on an external placement surface. The rotatable frame is provided on the base and is capable of being rotated on the base when driven by external force. The at least one clamping claw is located on the rotatable frame and configured for clamping a gift. The at least one impact device is arranged on a peripheral side of the base and configured for impacting the gift on the clamp claw when driven by external force.

17 Claims, 8 Drawing Sheets

(56) References Cited

U.S. PATENT DOCUMENTS

| | | | | | |
|---|---|---|---|---|---|
| 4,573,944 | A * | 3/1986 | Crow | A63H 17/045 | 446/336 |
| 4,895,364 | A * | 1/1990 | Martel | A63F 9/183 | 273/237 |
| 5,207,793 | A * | 5/1993 | Brand | A63F 9/30 | 273/440 |
| 5,219,433 | A * | 6/1993 | Zaruba | A63F 9/18 | 273/432 |
| 5,368,300 | A * | 11/1994 | Becker | A63F 7/025 | 273/119 R |
| 5,494,278 | A * | 2/1996 | Linden | A63B 69/0091 | 473/427 |
| 7,464,937 | B1 * | 12/2008 | Maggio | A63B 63/008 | 273/350 |
| 8,011,664 | B2 * | 9/2011 | Hilbert, Jr. | A63B 67/06 | 273/331 |
| 8,181,964 | B2 * | 5/2012 | Ritter | A63F 7/2472 | 273/445 |
| 8,574,101 | B2 * | 11/2013 | Wheel | G09B 19/0038 | 473/422 |
| 8,932,099 | B2 * | 1/2015 | Walker, Jr. | A63F 7/2418 | 446/176 |
| 9,446,324 | B2 * | 9/2016 | Barthold | A63H 7/00 | |

* cited by examiner

EDUCATIONAL TOY

CROSS REFERENCE TO RELATED APPLICATIONS

This application claims priority to Chinese Patent Application No. 202111388703.2, filed on Nov. 22, 2021, entitled "Educational Toy", which is hereby incorporated by reference.

FIELD OF THE DISCLOSURE

The disclosure relates to the field of children's toy products, in particularly to an educational toy.

BACKGROUND OF THE DISCLOSURE

Educational toys are toys that develop intelligence in the process of playing. There are many types of educational toys, such as building blocks or assembling games, which are common educational toys on the market.

Through playing with educational toys, the child's hand-foot coordination, hand-eye coordination and other physical functions are trained and gradually established. However, most of the existing educational toys are designed for developing children's intelligence and coordinating children's physical functions, but these educational toys are missing the interaction between the child and the parents, and most of the educational toys are played independently by the child. When the child is playing the toys, parents may accompany the child and guides them how to play the toys. Sometimes, the child may be too concentrated on the operation of the toys and lack communication with the parents. As such, parents' patience may be gradually lost during the accompanying process. Accordingly, the existing educational toys have shortcomings and need to be improved.

SUMMARY OF THE DISCLOSURE

In view of the above-mentioned problems, one object of the present disclosure is to provide an educational toy.

In order to achieve the above object, the present disclosure provide an educational toy. The educational toy comprises a base for placing on an external placement surface, a rotatable frame provided on the base and is capable of being rotated on the base when driven by external force, at least one clamping claw located on the rotatable frame and configured for clamping a gift, and at least one impact device arranged on a peripheral side of the base and configured for impacting the gift on the clamp claw when driven by external force.

In some embodiments, the impact device comprises an impact base provided on the peripheral side of the base and matched with the external placement surface, an elastic member located on the impact base and bendable away from the rotatable frame when driven by external force, and an impact part located on the elastic member and configured for impacting the gift on the clamping claw when the external force on the elastic member is removed.

In some embodiments, the elastic member is a spring.

In some embodiments, the impact base is provided with a base sleeve for inserting a first end of the spring, and the base sleeve is pierced with a base pin for securing the first end of the spring to the base sleeve.

In some embodiments, the impact part is provided with an impact part sleeve for inserting the end of the spring, and the impact part sleeve is pierced with an impact part pin to secure a second end of the spring to the impact sleeve.

In some embodiments, the impact part is glove-shaped.

In some embodiments, the base is provided with a fixed rod, and the rotatable frame is provided with a rotatable sleeve for fitting over an outside of the fixed rod.

In some embodiments, a stabilizing device is provided between the rotatable sleeve and the fixed rod to improve the stability of rotation when the rotatable frame rotates.

In some embodiments, the stabilizing device is a bearing that is arranged within the rotatable sleeve.

In some embodiments, an upper end of the rotatable frame is provided with a holding groove for holding a dice when the dice is thrown in.

In some embodiments, the clamping claw is an elastic clamping claw.

In some embodiments, the base is provided with a positioning disk for positioning the impact base on the outside of the rotatable frame.

In some embodiments, a peripheral side of the positioning plate is provided with a clamping groove for matching with the impact base to anchor the impact base to the positioning plate.

In some embodiments, the positioning plate is provided with a decompression device for massaging the fingers when the fingers are pressed.

In some embodiments, the decompression device comprises a plurality of decompression holes opened on the positioning plate, and a flexible button provided on the decompression hole.

In some embodiments, the flexible button is a silicone button.

In some embodiments, the clamping claw holds an accommodation egg for accommodating the gift; the accommodation egg comprises a left shell, and a right shell located on the left shell and separatable from the left shell when the accommodation egg is impacted by the impact device.

In some embodiments, the right shell is in snap connection with the left shell.

The educational toy provided by the present disclosure has the following advantages.

1. Gifts can be obtained by rotating the rotatable frame on the base and impacting the accommodation egg held by the clamping claws on the rotatable frame by the impact device. When the rotatable frame is rotated, concentration is needed to aim at the accommodation egg that follows the rotation of the rotatable frame, such that the child's concentration ability can be trained. When the impact device impacts, it needs to rely on the rebound of the spring when the force is applied away from the rotatable frame and then the applied force is removed to drive the glove-shaped impact part to impact. During the use process, the child's hands-on ability and hand-eye coordination ability are improved. At the same time, during use, there is competition and interaction between the child and the parents in order to be able to hit more accommodation eggs and get more gifts. The increasing interaction between the children improves the children's social skills and language skills.

2. The gift in the present disclosure is placed within the accommodation eggs. Children and parents will not be aware of what gifts are in the accommodation eggs before the accommodation eggs is opened. This uncertainty makes the toys more interesting. When the parents get a gift that the child desires or the gift in the hands of the child is not what they want, the child is encouraged to exchange gifts he/she already have with the parents to further improve the child's language ability. Vice versa, the parents may exchanges the gifts that the child likes, and develops the child's sharing feelings.

3. A plurality of silicone buttons are arranged on the positioning plate, so that children can exercise finger flexibility by pressing the silicone buttons and improve the child's concentration when pressing. Furthermore, it can also perform some games such as odd and even number training to exercise children's calculation ability and logical ability. Adults can also press the silicone button to make the massage effect of the silicone button stimulate the nerve endings of the fingers and improve the decompression effect for the body and mind.

DETAILED DESCRIPTION OF THE DISCLOSURE

The specific implements of the present disclosure will be further described below in conjunction with the accompanying drawings and embodiments. The following embodiments are only used to illustrate the technical solutions of the present disclosure more clearly and cannot be used to limit the protection scope of the present disclosure.

Figure 1:
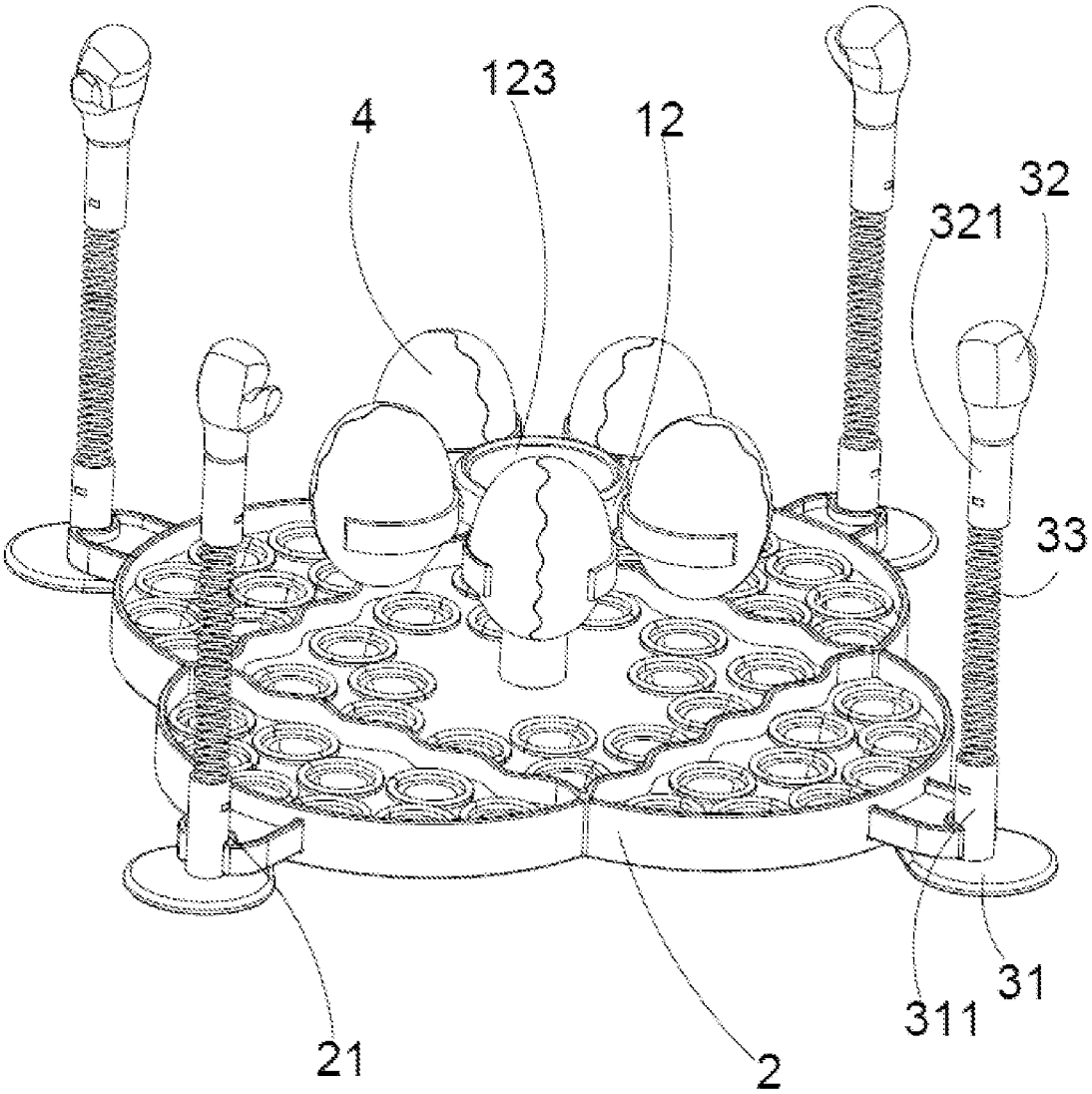
FIG. 1 is a schematic diagram of an educational toy in embodiments of the present disclosure.
Figure 2:
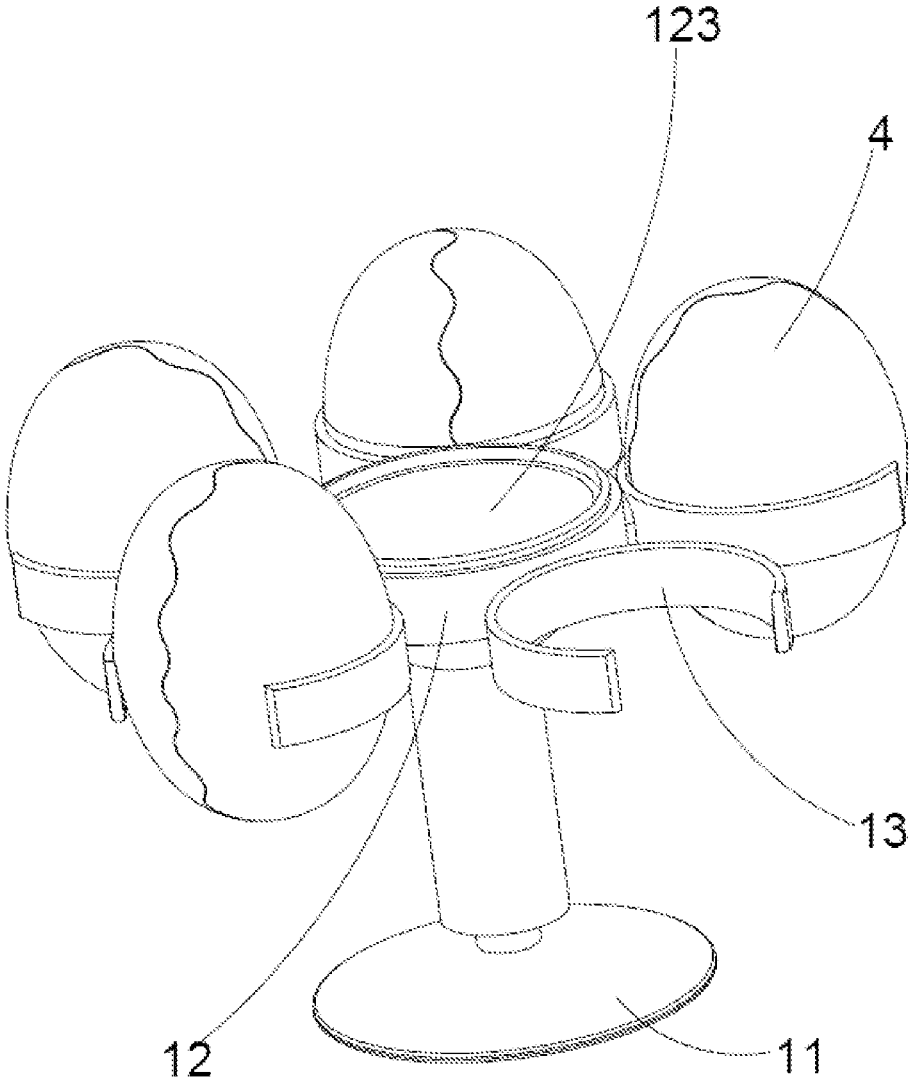
FIG. 2 is a partial schematic diagram of the educational toy in embodiments of the present disclosure.
Figure 3:
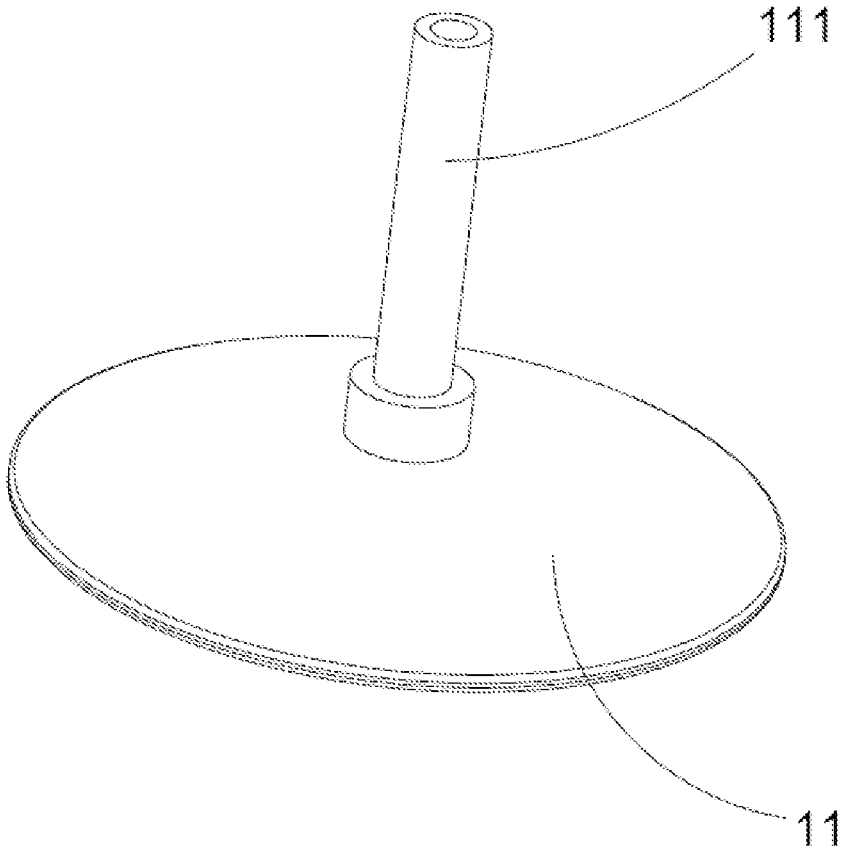
FIG. 3 is a schematic diagram of the base in embodiments of the present disclosure.
Figure 4:
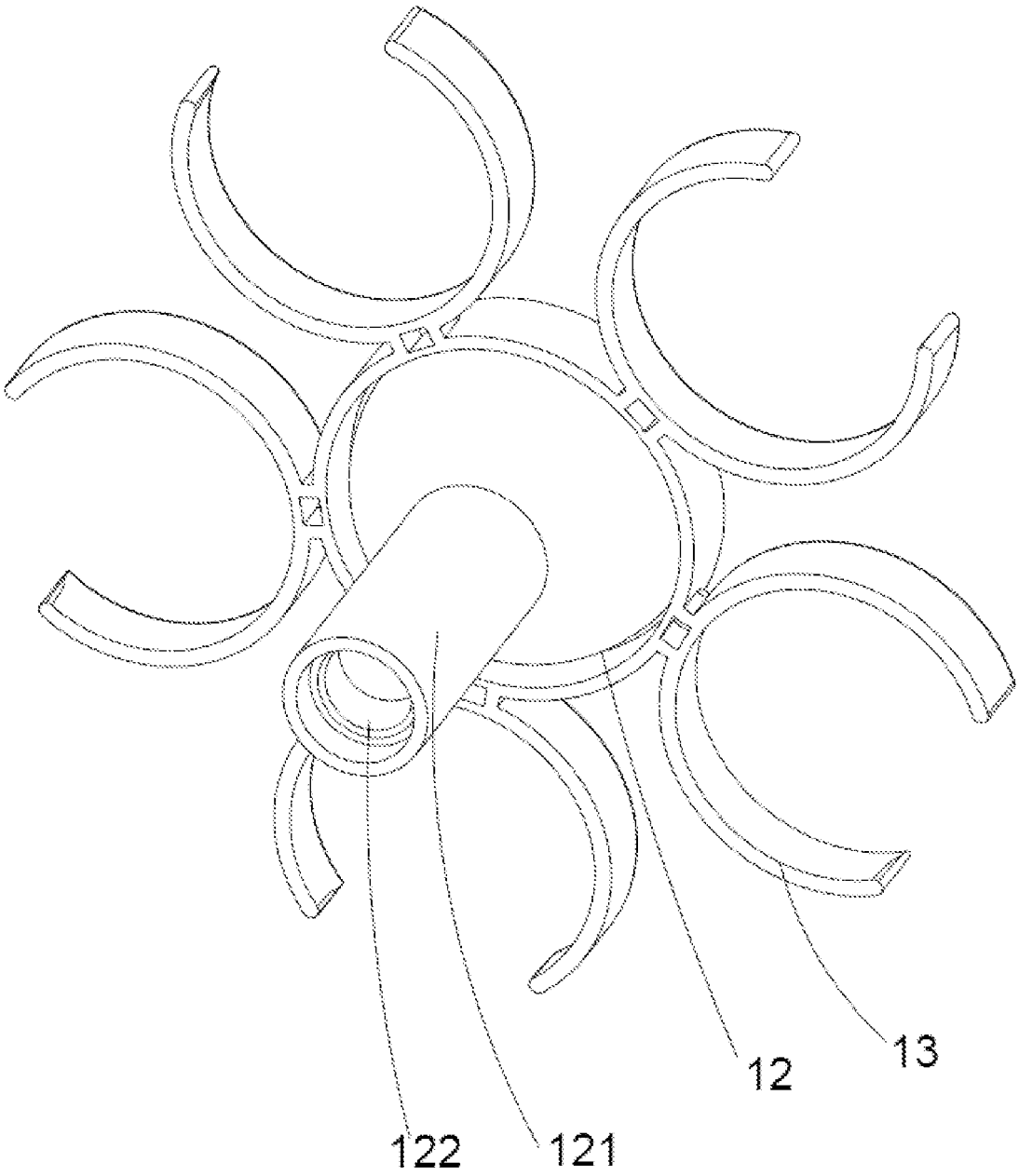
FIG. 4 is a schematic diagram of the rotatable frame in embodiments of the present disclosure.

Referring to FIG. 1 and FIG. 2, an educational toy is provided. The educational toy comprises a base 11 for placing on an external placement surface, a rotatable frame 12 provided on the base 11 and is capable of being rotated on the base 11 when driven by external force, at least one clamping claw 13 located on the rotatable frame 12 and configured for clamping a gift, and at least one impact device arranged on a peripheral side of the base 11 and configured for impacting the gift on the clamp claw 13 when driven by external force. Referring to FIG. 3 and FIG. 4, the base 11 is provided with a fixed rod 111, and the rotatable frame 12 is provided with a rotatable sleeve 121 for fitting over an outside of the fixed rod 111. A stabilizing device is provided between the rotatable sleeve 121 and the fixed rod 111 to improve the stability of rotation when the rotatable frame 12 rotates. The stabilizing device is a bearing 122 that is arranged within the rotatable sleeve 121. An upper end of the rotatable frame 12 is provided with a holding groove 123 for holding a dice when the dice is thrown in the holding groove.

Figure 5:
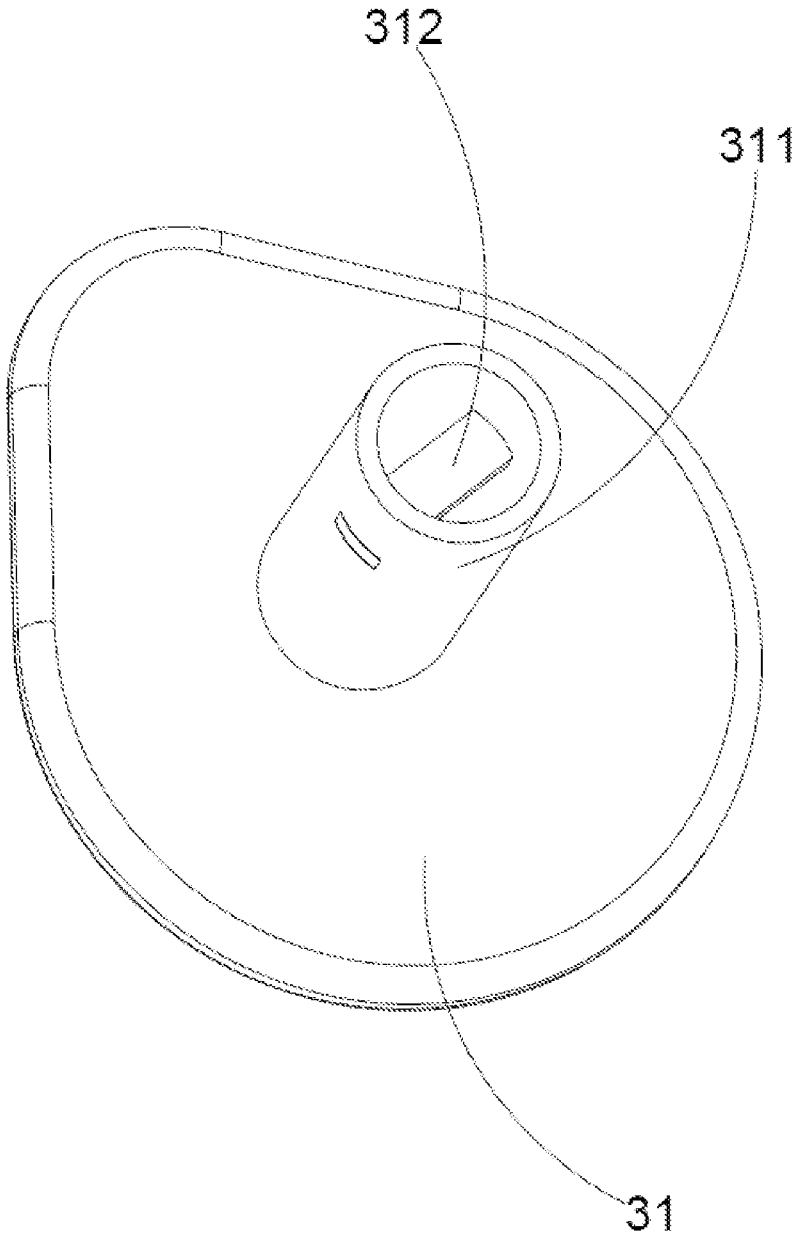
FIG. 5 is a schematic diagram of the impact base in embodiments of the present disclosure.
Figure 6:
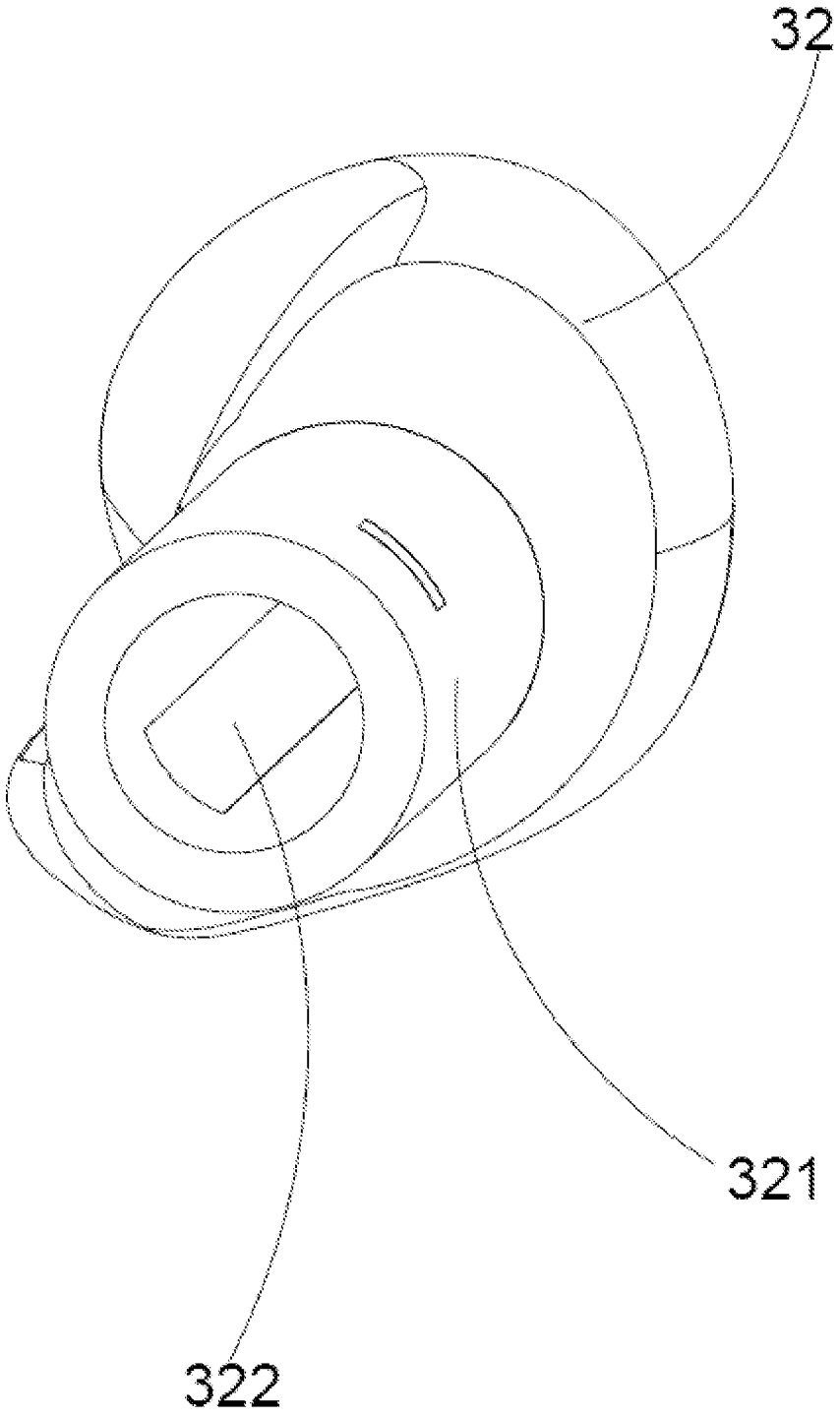
FIG. 6 is a schematic diagram of the glove-shaped striking part in embodiments of the present disclosure.

Referring to FIG. 1, FIG. 5 and FIG. 6, the impact device comprises an impact base 31 provided on the peripheral side of the base 11 and matched with the external placement surface, an elastic member located on the impact base 31 and bendable away from the rotatable frame 12 when driven by external force, and an impact part 32 located on the elastic member and configured for impacting the gift on the clamping claw 13 when the external force on the elastic member is removed. In the embodiments of the present disclosure, the elastic member is a spring 33. The impact base 31 is provided with a base sleeve 311 for inserting a first end of the spring 33, and the base sleeve 311 is pierced with a base pin 312 for securing the first end of the spring 33 to the base sleeve 311, even when the spring 33 is bend away from the rotatable frame 12 by external force. Accordingly, the base pin 312 is provided on the base sleeve 311 for securing the first end of the spring 33 within the base sleeve 311. Since there are gaps on the spring 33, the base pin 312 within the base sleeve 311 passes through the gap of the spring 33, and the spring 433 is anchored within the base sleeve 311. The glove-shaped impact part 32 is provided with a impact part sleeve 321 for inserting a second end of the spring 33. In order to prevent that the external force of the glove-shaped impact part 32 from separating from the spring 33 when the external force on the spring 33 is removed when the glove-shaped impact part 32 is impacting the gift on the elastic clamping claw 13. Accordingly, the impact part sleeve is pierced with an impact part pin 322 to secure a second end of the spring within the impact sleeve 321. Similarly, because of the gaps on the spring 33, the impact part pin 322 within the impact part sleeve 321 passes through the gap of the spring 33, and secure the spring 33 within the impact part sleeve 321. With the above arrangement, when on of the impact base 31 or the glove-shaped impact part 32 is damaged, it can be replaced by removing the base pin 312 or the impact part pin 322. When the spring 33 is damaged, the base pin 312 and the impact part pin 322 can be disassembled together to replace the spring 33. This replacement can be finished separately, which is less cost and less time-consuming.

Figure 7:
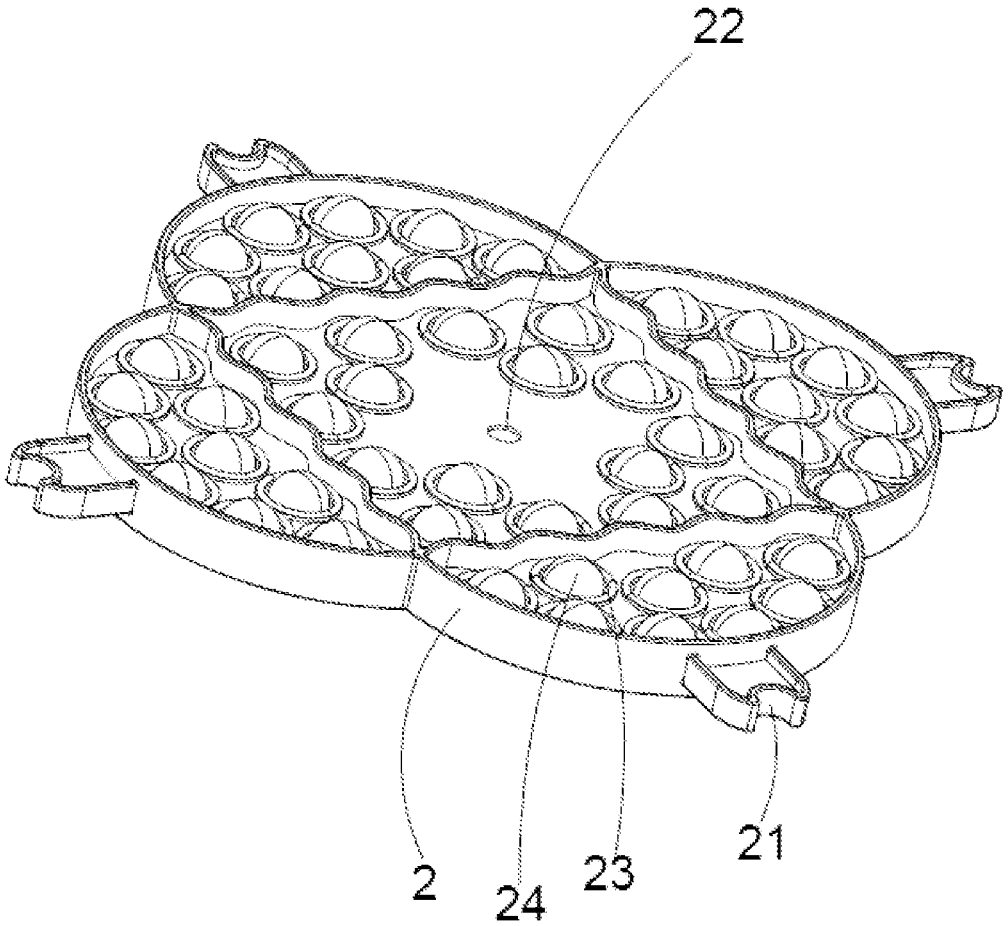
FIG. 7 is a schematic diagram of a positioning plate in embodiments of the present disclosure.

Referring to FIG. 1, FIG. 4 and FIG. 7, the base 11 is provided with a positioning plate 2 located outside the rotatable frame 12 for positioning the impact base 31. The peripheral side of the positioning plate 2 is provided with a clamping groove 21 for cooperating with the impact base 31 to secure the impact base 31 to the positioning plate 2 when the positioning plate 2 positioning the impact base 31. The center of the positioning plate 2 is provided with a rotating hole 22. When the positioning plate 2 is installed on the base, the rotating hole 22 on the positioning plate is aligned with the fixed rod 111 on the base 11, and the positioning plate is fitted over the fixed rod 111. Affected by its own gravity, the rotatable frame 12 pushes the rotating sleeve 121 to abut against the positioning plate 2. The positioning plate 2 is provided with a decompression device for massaging the fingers when the fingers is pressed on the decompression device. The decompression device comprises a plurality of decompression holes 23 opened on the positioning plate 2 and an elastic button provided on the decompression hole 23. The elastic button is a silicone button 24.

Figure 8:
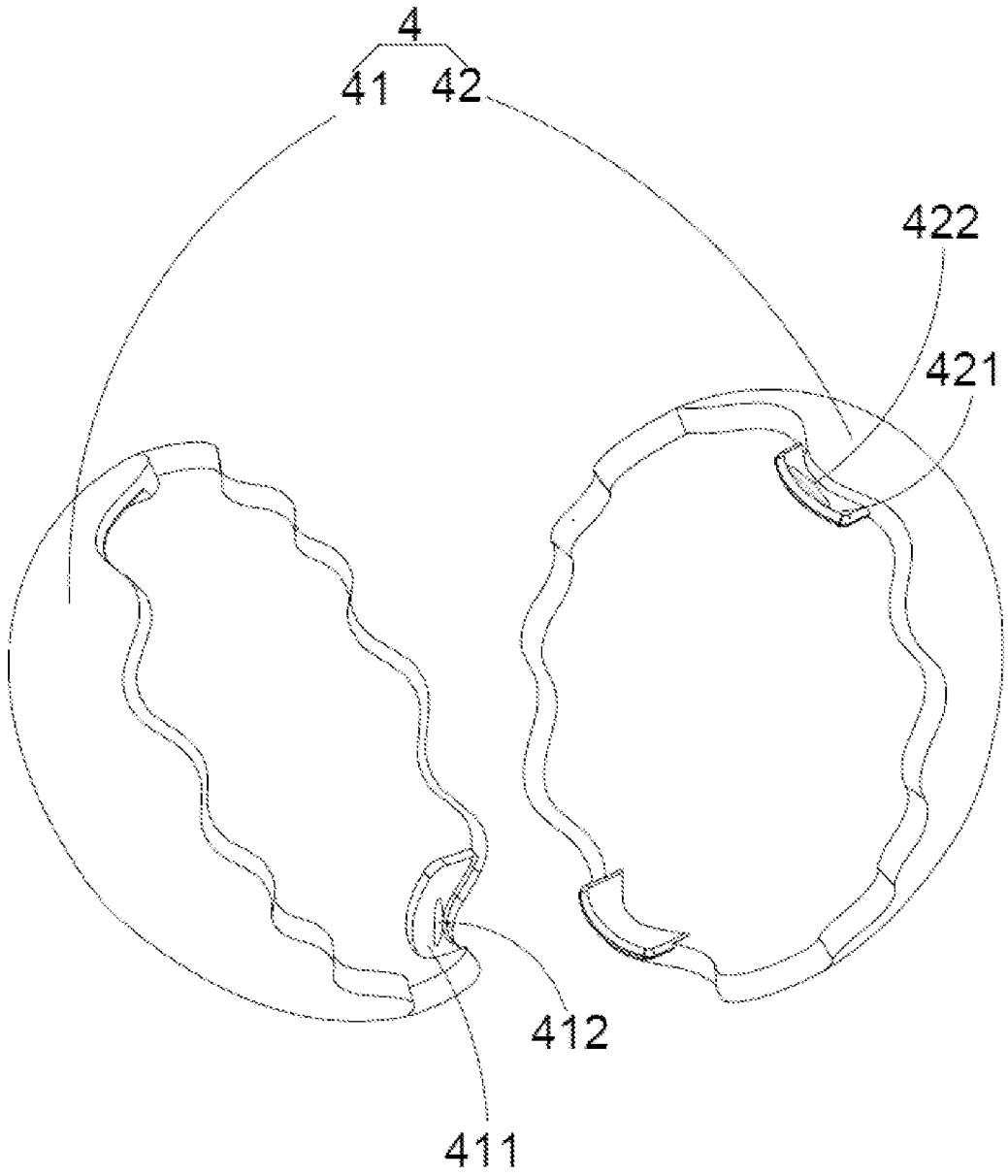
FIG. 8 is a schematic diagram of accommodation eggs in embodiments of the present disclosure.

Referring to FIG. 1, FIG. 2 and FIG. 8, in order to increase the fun of the toy, the elastic clamping claw 13 clamps an egg 4 for accommodating external gifts. By placing the gift in the containing egg 4, the child does not know what the gift is when playing, which increases the interest and interest of the child when playing. The egg 4 includes a left shell 41, and a right shell 42 which is provided on the left shell 41 and can be separated from the left shell 41 when the egg 4 is impacted by an impact device. The right shell 42 and the left shell 41 are snap-connected. In the embodiment of the present disclosure, the right shell 42 and the left shell 41 are snap-connected by an engaging device provided between the right shell 42 and the left shell 41. The clamping device includes two connecting plates 421 symmetrically arranged on the right shell 42, a clamping post 422 arranged on the connecting plate 421, and a connecting plate arranged on the left shell 41 for mating with the connecting plate. The connecting groove 411 into which the 421 is inserted, and the clamping groove 412 provided on the connecting groove 411 for mating and clamping with the clamping post 422 on the connecting plate 421.

The present disclosure provides an educational toy. When installing, first aligning the rotating hole 22 on the positioning plate 2 with the fixed rod 111 on the base 11. Then, the positioning disk 2 is fitted over the fixed rod 111. Afterwards, the rotatable frame 12 is installed, and the rotating sleeve 121 on the rotating frame 12 is fitted over the fixed rod 111. Affected by its own gravity, the rotatable frame 12 pushes the rotating sleeve 121 to abut against the positioning plate 2. Then, the egg 4 containing the gift is clamped on the elastic clamping claw 13. At last, the base sleeve 311 on the installed impact device is engaged with the clamping groove 21 on the positioning plate 2 to complete the positioning of the impact device.

The present disclosure provides the educational toy. When in use, a first user throws a dice in the holding groove 123 on the rotatable frame 12. Then, a second user rotates the rotatable frame 12. During the rotation of the rotatable frame 12, the first user impacts the egg 4 on the rotatable frame 12 through the impact device (the number of dice points the impacting times of the impact device), so that the egg 4 falls from the elastic clamping claws 13 of the rotatable frame 12. The right shell 42 and the left shell 41 accommodating the egg 4 are separated when impacted by the impact device, so that the gift in the egg 4 is exposed in front of users.

When the rotatable frame 12 is rotated, it is necessary to focus on the eggs 4 that follow the rotation of the rotatable frame 12, so that the child's concentration ability can be trained. At the same time, the impact device needs to rely on the rebound of the spring 33 when the force is applied away from the rotatable frame 12 and then the applied force is withdrawn to drive the glove-shaped impact part 32 to strike. Therefore, the child's hands-on ability and hand-eye coordination ability are improved during use. At the same time, in the process of use, there is competition and interaction between the child and the parents in order to be able to impact more eggs 4 to get more gifts, which increases the interaction between the child and the parents and improves the child's social skills and language skills. In addition, when the parents get the gift that the child desires or the gift in the child's hand is not what they want, the child may exchange gifts with the parents, and that improves the child's language ability. Vice versa, parents can exchange gifts they like with the child, which develops the child's sharing feeling.

In addition, there are a number of silicone buttons 24 on the positioning plate 2, and the child can exercise finger flexibility by pressing the silicone buttons 24. In addition, some games such as odd and even number training can be used to exercise children's numeracy and logical abilities. Moreover, adults can also press the silicone button 24 so that the massage effect of the silicone button 24 stimulates the nerve endings of the fingers and decompress the body and mind.

The above is only the preferred implementation mode of the present disclosure. It should be noted that for ordinary technicians in the technical field, without deviating from the principles of the disclosure, a number of improvements and refinements may be made, which shall also be considered as the scope of protection of the present disclosure.

What is claimed is:

1. An educational toy, comprising:

a base for placing on an external placement surface, a rotatable frame provided on the base and is capable of being rotated on the base when driven by external force, at least one clamping claw located on the rotatable frame and configured for clamping a gift, and at least one impact device arranged on a peripheral side of the base and configured for impacting the gift on the clamp claw when driven by external force;

the clamping claw holds an accommodation egg for accommodating the gift the accommodation egg comprises a left shell, and a right shell located on the left shell and separatable from the left shell when the accommodation egg is impacted by the impact device.

2. The educational toy according to claim 1, wherein the impact device comprises:

an impact base provided on the peripheral side of the base and adapted for the external placement surface;

an elastic member located on the impact base and bendable away from the rotatable frame when driven by external force, and an impact part located on the elastic member and configured for impacting the gift on the clamping claw when the external force on the elastic member is removed.

3. The educational toy according to claim 2, wherein the elastic member is a spring.

4. The educational toy according to claim 3, wherein the impact base is provided with a base sleeve for inserting a first end of the spring, and the base sleeve is pierced with a base pin for securing the first end of the spring to the base sleeve.

5. The educational toy according to claim 3, wherein the impact part is provided with an impact part sleeve for inserting a second end of the spring, and the impact part sleeve is pierced with an impact part pin to secure the second end of the spring to the impact sleeve.

6. The educational toy according to claim 2, wherein the impact part is glove-shaped.

7. The educational toy according to claim 2, wherein a positioning plate is located on the base for positioning the impact base on the outside of the rotatable frame.

8. The educational toy according to claim 7, wherein a peripheral side of the positioning plate is provided with a clamping groove for matching with the impact base to anchor the impact base to the positioning plate.

9. The educational toy according to claim 7, wherein the positioning plate is provided with a decompression device for massaging the fingers when the fingers are pressed.

10. The educational toy according to claim 9, wherein the decompression device comprises a plurality of decompression holes opened on the positioning plate, and a flexible button provided on the decompression hole.

11. The educational toy according to claim 10, wherein the flexible button is a silicone button.

12. The educational toy according to claim 1, wherein the base is provided with a fixed rod, and the rotatable frame is provided with a rotatable sleeve for fitting over an outside of the fixed rod.

13. The educational toy according to claim 12, wherein a stabilizing device is provided between the rotatable sleeve and the fixed rod to improve the stability of rotation when the rotatable frame rotates.

14. The educational toy according to claim 13, wherein the stabilizing device is a bearing that is arranged within the rotatable sleeve.

15. The educational toy according to claim 1, wherein an upper end of the rotatable frame is provided with a holding groove for holding a dice when the dice is thrown in.

16. The educational toy according to claim 1, wherein the clamping claw is an elastic clamping claw.

17. The educational toy according to claim 1, wherein the right shell is in snap connection with the left shell.

* * * * *